US008007094B2

(12) United States Patent
Ujita

(10) Patent No.: US 8,007,094 B2
(45) Date of Patent: Aug. 30, 2011

(54) INK JET CARTRIDGE

(75) Inventor: Toshihiko Ujita, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 552 days.

(21) Appl. No.: 12/136,739

(22) Filed: Jun. 10, 2008

(65) Prior Publication Data

US 2008/0303880 A1 Dec. 11, 2008

(30) Foreign Application Priority Data

Jun. 11, 2007 (JP) ..... 2007-154039

(51) Int. Cl.
*B41J 2/01* (2006.01)

(52) U.S. Cl. ..... 347/87; 347/84; 347/85; 347/86

(58) Field of Classification Search ..... 347/86, 347/85, 84, 87
See application file for complete search history.

(56) References Cited

U.S. PATENT DOCUMENTS

| | | | | |
|---|---|---|---|---|
| 5,671,000 | A * | 9/1997 | Hirabayashi et al. | 347/86 |
| 6,490,792 | B1 * | 12/2002 | Ishinaga et al. | 347/86 |
| 2003/0052951 | A1 * | 3/2003 | Ujita et al. | 347/86 |

FOREIGN PATENT DOCUMENTS

| | | |
|---|---|---|
| JP | 5-254138 | 10/1993 |
| JP | 8-118676 | 5/1996 |

* cited by examiner

*Primary Examiner* — Manish S Shah
(74) *Attorney, Agent, or Firm* — Canon USA Inc IP Division

(57) ABSTRACT

The present invention provides an ink jet cartridge configured such that an absorber is housed in one space while ink is accommodated in the other space, the ink jet cartridge keeping the ink sealed during distribution. The ink jet cartridge has an ink tank portion that accommodates ink, a print head portion that ejects the accommodated ink, and an ink supply path connected between the ink tank portion and the print head portion. A seal member that seals the ink supply path is located on an ink tank portion side of the ink supply path.

13 Claims, 10 Drawing Sheets

INK JET CARTRIDGE

BACKGROUND OF THE INVENTION

1. Field of the Invention

The present invention relates to an ink jet cartridge having an ink tank portion and a print head portion which are integrally formed or coupled together so as to form one member.

2. Description of the Related Art

Examples of ink tanks for use in ink jet printing apparatuses include an ink jet cartridge having a print head. The ink jet cartridge has a print head portion 801 and an ink tank portion 802 which are integrally formed, for example, as shown in FIG. 9. The print head portion 801 has ejection ports 804 through which ink is ejected, and the ink tank portion 802 accommodates ink to be supplied to the print head portion 801. An absorber 803 impregnated with ink is housed in the ink tank portion 802. The absorber 803 is formed of a sponge or the like. The print head portion 801 and the ink tank portion 802 can be integrally installed on and removed from a holder in an ink jet printing apparatus.

If such an ink jet cartridge is adapted for color printing, the ink jet cartridge may need to eject, for example, at least three types of ink corresponding to at least three colors. In this case, in connection with the positions and arrangement of the ejection ports, formed in the print head portion, a manufacturing process is facilitated by forming all the ejection ports in as few semiconductor substrates as possible. This is because when the positional relationship among a plurality of nozzle rows corresponding to a plurality of colors is to be accurately established (on the order of microns), manufacturing can be achieved with the positional relationship among the nozzle rows maintained, by arranging all the color nozzles in one substrate. Thus, even when the nozzle rows correspond to the plurality of colors, the colors are unlikely to be misaligned upon impacting a print medium. This is why a scheme of arranging a plurality of colors on one semiconductor substrate has been adopted.

However, if a plurality of inks corresponding to a plurality of nozzles is provided in one print head portion with the ink tank and the print head formed as one member, the consumption of the ink may vary among the inks of the different colors. Thus, when ink of one color is exhausted in spite of sufficient amounts of inks of the other colors remaining, the ink jet cartridge housing the inks of all the colors needs to be changed.

In contrast, an ink jet cartridge is known which has separate print head portions for the respective colors and in which each of the print head portions is integrated with the corresponding ink tank portion. When the print head portions for the respective colors are provided as in the case of this ink jet cartridge, the ink of each color can be fully used up. The use efficiency of the inks is thus improved. This also reduces the amount of waste ink and thus adverse effects on the environment.

However, volume efficiency decreases, which is the rate of an ink accommodation volume in the volume of the whole ink jet cartridge. This increases the size of the ink jet cartridge relative to the size of other types of ink jet cartridges of the same ink capacity. According to the present inventors' examinations, with a scheme in which absorbers such as sponges are housed in the respective ink tank portions of the ink jet cartridge, usable ink amount is about 50% of the volume of the ink tank portion.

Furthermore, in the ink jet cartridge of this type, the absorbers not only hold the ink but also generate appropriate negative pressure in the ink reaching nozzles in the print head portion, on the basis of the capillary force of recesses and protrusions on the surface of each of the absorbers. The negative pressure is thus generated in the print head portion to prevent the ink from leaking from the print head portion except during printing. Further, there is another scheme of utilizing water head difference for ink jet printing apparatuses. However, with this scheme, the ink tanks need to be positioned higher than an ejection port surface on which the ejection ports are formed. Consequently, installing the ink jet cartridge, which this structure kept as it is on a carriage, is difficult. Furthermore, it is required that the ink is supplied through tubes from the ink tank portion to the print head portion. This complicates the structure and increases manufacturing costs.

Another scheme of generating negative pressure inside the print head is means for generating negative pressure using a mechanical regulator apparatus. However, it is technically difficult to accurately and continuously generate a negative pressure required for ink jet printing apparatuses (−100 Pa to −3000 Pa). This also increases the number of parts required and thus tends to increase costs. Furthermore, parts used to generate the negative pressure tend to be large, increasing the rate of the volume of these parts in the volume of the ink jet cartridge. This reduces the rate of the volume of the ink tank portion in which the ink is accommodated. Additionally, an ink storing portion needs to be provided which prevents ink from leaking from the print head portion even with a change in posture or environment.

Another scheme houses ink in a bag located inside a housing and formed of a flexible film. The scheme involves placing a spring inside the bag to adjust the pressure inside the bag while maintaining the shape of the bag, by means of the spring. The ink jet cartridge based on this scheme makes it possible to generate negative pressure in the ink storing portion while storing the ink in the ink storing portion. However, the ink jet cartridge based on this scheme increases the number of parts required and requires the delicate and flexible bag to allow to generate the negative pressure and to keep in a stable condition. The ink jet cartridge thus requires high manufacturing costs. The costs cannot be offset and the adoption of the ink jet cartridge based on this scheme is not advantageous, unless a printing apparatus using pigment inks which may precipitate or applied to any other special purpose is used. With the pigment ink, the pigment component of the ink precipitates to the bottom of the ink, requiring a mechanism for agitating the ink. The ink jet cartridge based on this scheme advantageously ensures a space in the ink storing section which is required to agitate the ink. Consequently, the precipitated pigment ink can be agitated before being ejected.

An example of means for solving these problems is an ink tank configured such that an absorber is housed in one space while ink is accommodated in the other space, with the spaces partitioned by a partition wall having a communication portion formed in a part thereof. The ink tank of this type is called a partially-absorber-stored-type. The amount of usable ink in this ink tank type is at least about 70% of the tank volume. The ink tank type thus has a relatively high volume efficiency.

FIG. 10 shows a form of a conventional ink tank 900 based on this scheme. An absorber 907 that absorbs and holds ink is housed in an absorber chamber 903. An atmospheric communicating port 905 through which open air is taken in is formed in a part of a wall surface of the absorber chamber 903 of the ink tank, which is located farther from the print head. A supply port 906 and a pressure contact member 908 are arranged in an area of the absorber chamber 903 which is closer to the print head. Ink is supplied to the print head through the supply port 906, and the pressure contact member 908 guides the ink from the absorber 907 to the vicinity of the supply port 906 for collection by means of a capillary force stronger than that of the absorber 907. The pressure contact member 908 has a function of passing the ink to a capillary part (for example, a high-density filter) located in an ink channel extending from the ink tank portion to the print head to take in the ink. With the ink tank 900 placed on the carriage, negative pressure can be generated by the capillary forces of the absorber 907 and the pressure contact member 908. This prevents the ink from leaking through the ejection ports.

With the ink tank 900, configured such that the absorber is housed in one space while the ink is accommodated in the other space, the ink can be stably supplied. The ink tank 900 also allows negative pressure to be generated inside the print head using a simple structure, reducing the number of the parts required. Consequently, the ink tank can be manufactured by reduced costs. This scheme is also advantageous in that the presence or remaining amount of ink can be checked by making a container as the ink storing portion 901 to be transparent and placing optical means, for example, a reflection prism 902, inside the container.

The ink tank based on this scheme has been examined by the present inventors and adopted for many commercially available ink tanks. However, attention needs to be paid to the form in distribution of the ink tank owing to the structure and nature thereof.

The ink tank 900 of this type is shipped after the ink storing portion 901 and the absorber chamber 903 have been filled with ink in a factory or the like. However, during distribution from shipment in the factory until delivery to users, the ink in the ink tank becomes unstable because of possible vibration during conveyance or a possible variation in atmospheric pressure or temperature during storage. As a result, the ink may leak to the exterior.

In particular, the flow of air from the absorber chamber 903 to the ink storing portion 901 results from, for example, a variation in the volume of ink caused by the repeated freezing and unfreezing of the ink. In this case, the ink flows in one direction, and when the flow occurs, the ink flows from the absorber chamber 903 to the ink storing portion 901. The ink in the ink storing portion 901 is then replaced with air. Instead, the ink flows into the absorber chamber 903. When an excessive amount of ink flows into the absorber chamber 903, the absorber 907 is fully impregnated with the ink. When the absorber 907 is fully impregnated with the ink, the capillary force thereof is lost. In this case, the ink may leak to the exterior unless the ink tank, the ejection ports in the print head portion, and the like is sealed.

During the distribution of the ink tank configured such that the absorber is housed in one space while the ink is accommodated in the other space, tight sealing is required to prevent the ink from leaking to the exterior. As shown in FIG. 10, the atmospheric communicating port 905 is blocked with a seal 909, and a cap 910 with an elastomer 911 located on an inner surface thereof is installed over the supply port 906.

Means for preventing ink from leaking through the ejection ports in the print head portion is disclosed in, for example, Japanese Patent Laid-Open No. 5-254138. In particular, Japanese Patent Laid-Open No. 5-254138 discloses, for example, a spherical valve, formed of resin or a metal material, is located in the ink channel between the ink tank portion and the print head portion and biased by a spring so that the valve slides to adjust the flow of the ink. However, since the direction in which the valve is opened and closed is parallel to the direction of the flow of the ink, it is difficult to reliably open and close the valve in the sealed channel using a simple operation in a simple structure.

Furthermore, as described above, during distribution, the surrounding environment of the ink tank may vary significantly. Consequently, the pressure inside the ink tank portion may vary markedly. Furthermore, while the ink tank is exposed to distribution conditions over a long period, the air surrounding the ink tank may pass through the wall surface of the ink tank and enter the inside of the ink tank portion. This increases the pressure inside the ink tank portion. When the inside of the ink tank portion is sealed, the internal pressure of the ink tank portion may remove the seal.

In connection with this, Japanese Patent laid-Open No. 8-118676 discloses an ink jet cartridge having a hydrophobic film over an atmospheric communicating port to allow gas to pass through while preventing the flow of liquid. Since gas is allowed to pass through the atmospheric communicating port, the internal air can be discharged according to the pressure of the ink tank portion, enabling the internal pressure to be adjusted. The hydrophobic film needs to be repellent to ink in order to maintain appropriate functions. However, the water repellency has been found to be degraded during a long distribution period in which the hydrophobic film is exposed to the ink or vapor from the ink. Since the distribution period of the ink cartridge may span several years, the ink jet cartridge disadvantageously cannot be adopted until it is recognized whether the water repellency of the hydrophobic film can be maintained over the distribution period.

For the ink tank configured such that the absorber is formed in one space while the ink is accommodated in the other space, an ink jet cartridge having an ink tank portion and a print head portion which are integrally formed may be provided. The ink jet cartridge of this type uses an absorber or the like formed of a sponge to generate negative pressure using a simple structure. When the ink jet cartridge of this type is used, to prevent the possible leakage of the ink caused by an unstable environment during distribution, it is possible to apply a seal tape over the ejection ports in the print head portion.

However, a very adhesive seal tape cannot be adopted for an ink jet printing apparatus adopting an ink jet cartridge having an ink tank portion and a print head portion which are formed as one member. This is because in the ink jet printing apparatus of this type, the ejection ports in the print head portion of the ink jet cartridge are formed to have a very small diameter. If such a seal tape that prevents the possible leakage of the ink through the ejection ports during distribution is applied to the ink jet cartridge, the seal tape needs to have enough adhesiveness to overcome a variation in the internal pressure of the ink tank portion over the distribution period. Thus, in this case, a sufficient amount of paste material needs to be applied to a surface to which the seal tape is applied. However, if the seal tape with the sufficient amount of paste material applied thereto is applied over the ejection ports, the paste material applied to the seal tape application surface may flow into and remain in the ejection ports.

Furthermore, in general, the peripheral area of the ejection ports in the print head portion is not ensured to have high strength. Thus, if such a very adhesive seal tape is applied to the periphery of the ejection ports, the peripheral area of the ejection ports in the print head portion may be deformed when the seal tape is peeled off to allow the use of the ink jet cartridge. Consequently, if the seal tape is applied to the periphery of the ejection ports in the print head portion, the adhesivity cannot be enhanced and is intentionally set low. It is thus difficult to apply the seal tape over the ejection ports in the print head portion to prevent the ink from leaking through the ejection ports to form a sealed structure.

Furthermore, since the seal tape applied over the peripheral area of the ejection ports is not very adhesive, when the pressure inside the ink tank portion increases, the seal tape may be peeled off during distribution, resulting in the leakage of the ink. Thus, since the seal tape is not very adhesive, the ink jet cartridge having the ink tank portion and the print head portion which are formed as one member cannot withstand an unstable environment during distribution. This may result in the leakage of the ink.

SUMMARY OF THE INVENTION

The present invention is directed to an ink jet cartridge that prevents possible ink leakage during distribution. According to an aspect of the present invention, an ink jet cartridge has an ink tank portion and a print head portion. The ink tank portion accommodates ink, and the print head portion is supplied with ink accommodated in the ink tank portion and ejects the supplied ink. The cartridge also includes a print head portion-side ink inflow portion and an ink tank portion-side ink supply portion connecting the ink tank portion to the print head portion so as to supply the ink from the ink tank portion to the print head portion. The cartridge also has a seal member located and sandwiched between the print head portion-side ink inflow portion and the ink tank portion-side ink supply portion.

According to the present invention, during distribution when the ink jet cartridge is exposed to an unstable environment, the condition in which the ink is sealed is maintained in the ink jet cartridge. Consequently, during distribution, the ink accommodated in the ink jet cartridge can be prevented from leaking to the exterior. The ink can thus be inhibited from adhering to the periphery of the ink jet cartridge when the ink jet cartridge is unsealed or used. This in turn prevents the ink from adhering to the user, who can comfortably handle the ink jet printing apparatus. Furthermore, the impacting accuracy of the ink can be inhibited from being reduced by the possible attachment of the ink to the periphery of the print head portion. Ink ejection with a high impacting accuracy can thus be maintained. Therefore, image quality achieved by printing can be kept high. The present invention can also prevent the print head portion from being corroded by the possible attachment of the ink to the print head portion over a long period. Therefore, the durability of the ink jet cartridge can be improved.

Further features of the present invention will become apparent from the following description of exemplary embodiments (with reference to the attached drawings).

DESCRIPTION OF THE EMBODIMENTS

First Embodiment

A first embodiment of the present invention will be described below with reference to the attached drawings.

Figure 1:
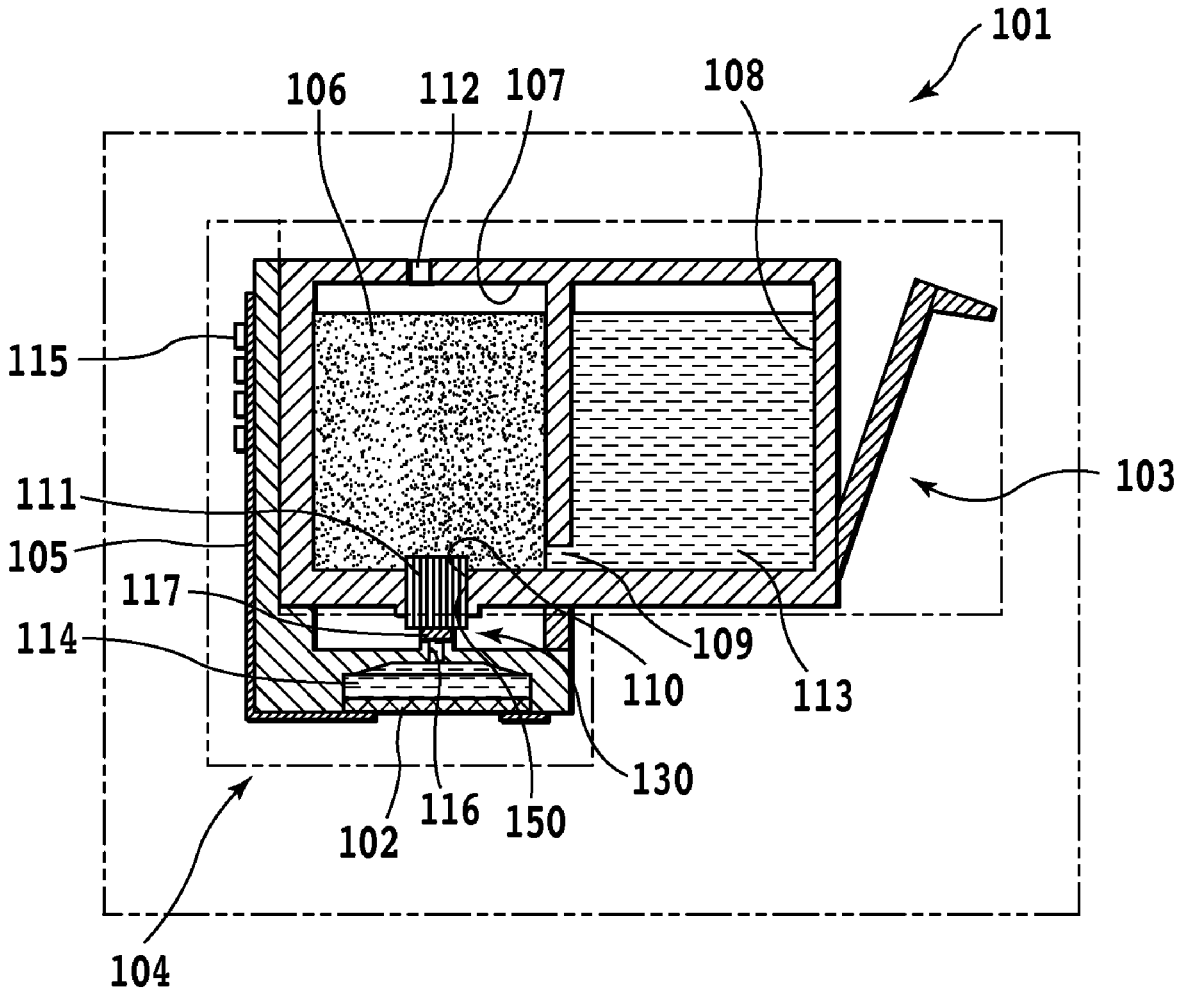
FIG. 1 is a sectional view of an ink jet cartridge from which a seal member has been peeled off according to a first embodiment of the present invention.

FIG. 1 is a sectional view of an operative condition of an ink jet cartridge applied to the first embodiment of the present invention and having an ink tank portion and a print head portion which are formed as one member. Since the ink jet cartridge shown in FIG. 1 is in the operative condition, a seal member blocking the print head portion, an ink supply port, and an atmospheric communicating port has already been peeled. In this case, the seal member is not applied to the ink jet cartridge.

An ink jet cartridge 101 shown in FIG. 1 has an ink tank portion 103 and a print head portion 104. In the present embodiment, the ink tank portion 103 and the print head potion 104 are separately manufactured and then coupled together. The ink tank portion 103 and the print head portion 104 may be integrally formed. The ink tank portion 103 and the print head portion 104 may be integrally formed or coupled together to form the ink jet cartridge 101 constituting one member. In this case, if the separately manufactured ink tank portion 103 and print head portion 104 are coupled and assembled together, it is assumed that ink tank portion 103 and print head portion 104 have been coupled and assembled together before distribution. The ink tank portion 103 stores ink, while supplying the ink to the print head portion 104. The print head portion 104 has ejection ports 102 formed therein at a leading end thereof opposite a print medium. The ink jet cartridge 101 has an ink supply path 150 between the ink tank portion 103 and the print head portion 104 to supply the ink accommodated in the ink tank portion 103, to the print head portion 104. The ink jet cartridge 101 has a wire 105 attached thereto to transmit external electric energy and electric signals required to eject the ink through ejection ports 102.

The ink tank portion 103 has an absorber chamber 107 that holds an absorber 106 impregnated with the ink, and an ink storing portion 108 that supplies the ink in the absorber chamber 107. The absorber 106 has a large number of holes on a surface thereof so that negative pressure generated by a capillary force exerted by the holes allows meniscus to be stably formed at the ejection ports 102.

The ink storing portion 108 of the ink tank portion 103 is in communication with the absorber chamber 107 through an ink flow passage 109. In the present embodiment, the ink storing portion 108 has no flow passage through which the ink storing portion is in communication with any other space, other than the ink flow passage 109, through which the ink storing portion 108 is in communication with the absorber chamber 107. An ink supply port 110 is formed close to the print head portion 104 of the absorber chamber 107 to supply the ink from the absorber chamber 107 to the print head portion 104. A pressure contact member 111 exerting a stronger capillary force than the absorber 106 is located in the ink channel downstream of the ink absorber 106. A pressure contact member 111 is regulated to move only in the same direction as that in which the ink is ejected. An atmospheric communicating port 112 that is in communication with the exterior of the ink jet cartridge 101 is formed in the absorber chamber 107 opposite the ink supply port 110.

The pressure contact member 111 is in pressure contact with the absorber 106 which has elasticity. This serves to exert a capillary force that is stronger than that of the absorber 106, generating a further negative pressure. The pressure contact member 111 has the horizontal movement thereof regulated but is movable in the same direction as that in which the ink is ejected. The pressure contact member 111 is pushed by the absorber 106 to exert a force acting toward the exterior of the ink tank portion 103.

The print head portion 104 has an ink jet chip 114. The ink jet chip 114 is formed of a semiconductor substrate and has the fine ejection ports 102, formed by a photolithography technique, and the ink channel through which the ink is supplied to the ejection ports 102. The ejection ports 102 are open so as to be able to eject the ink supplied from the ink tank portion 103. A plurality of fine heaters are arranged at positions corresponding to the respective ejection ports 102 and serve as electrothermal resistors. The heaters are arranged in the ink jet chip 114 to transduce electric energy into thermal energy to apply thermal energy to the ink to eject the ink as droplets. Electrode pads 115 are arranged at positions corresponding to electrodes arranged on a carriage in an ink jet printing apparatus main body, to supply electric energy to the heaters. A wire 105 is located between the electrode pads 115 and the heaters to transmit electricity fed from the carriage in the ink jet printing apparatus main body to the electrode pads 115 on the ink jet cartridge 101, to the heaters on the ink jet chip 114. A hole is formed in a part of the semiconductor substrate in the ink jet chip 114 so that the ink is fed from the ink tank portion 103 to the ink jet chip 114 via the hole.

A reflecting prism 113 is located in the ink storing portion 108 to display the presence or absence of ink or the remaining amount thereof using optical means. The ink tank portion 103 is formed of a transparent resin typified by polypropylene. The ink has a refractive index much closer to that of the transparent resin than to that of air. If the reflecting prism 113 is arranged on an inner surface of the ink storing portion 108, the presence or absence of the ink can be determined on the basis of the presence or absence of light reflection from the reflecting prism 113. When the ink is exhausted while one print medium is being printed, precluding subsequent printing, the incompletely printed print medium and the time spent for the printing are wasted. The reflecting prism 113 is provided to avoid these inconveniences.

In the ink jet cartridge according to the present embodiment, the ink storing portion 108, accommodating the ink, and the absorber chamber 107, housing the absorber 106, are separately formed in the ink tank portion. This makes it possible to place the reflecting prism 113, which allows the sensing of the presence or absence of ink and the remaining amount thereof, in the ink storing portion 108, which internally has a relatively large free space.

When the ink in the absorber 106 inside the absorber chamber 107 is consumed as a supply to the ejection ports 102, air taken in through the atmospheric communicating port 112, located at the top of the absorber chamber 107, is supplied to the ink storing portion 108 through the ink flow passage 109. Thus, the ink inside the ink storing portion 108 is substituted with the air taken in through the atmospheric communicating port to fill the absorber chamber 107 with the ink. In this manner, the ink is supplied to the absorber chamber 107 until the ink inside the ink storing portion 108 is exhausted. When the supply of the ink from the ink storing portion 108 to the absorber chamber 107 is stopped, this means that the ink has been exhausted. At the same time, the negative pressure generated by the absorber 106 rises, and the flow resistance of the ink increases. This makes it difficult to supply the ink to the ejection port 102, finally precluding printing. It is effective to place the reflecting prism in the ink storing portion 108 in order to avoid the above-described situation.

Here, as described above, the pressure contact member 111, located at the ink supply port 110 in the ink tank portion 103 is pressed against the absorber 106. Consequently, the repulsive force of the absorber 106 exerts a force that moves the pressure contact member 111 outward with respect to the ink tank portion 103. As a result, the pressure contact member 111 is in pressure contact with the absorber 106 while being subjected to a force pushing the pressure contact member 111 toward an ink inflow port 116 in the print head portion 104.

Figure 2:
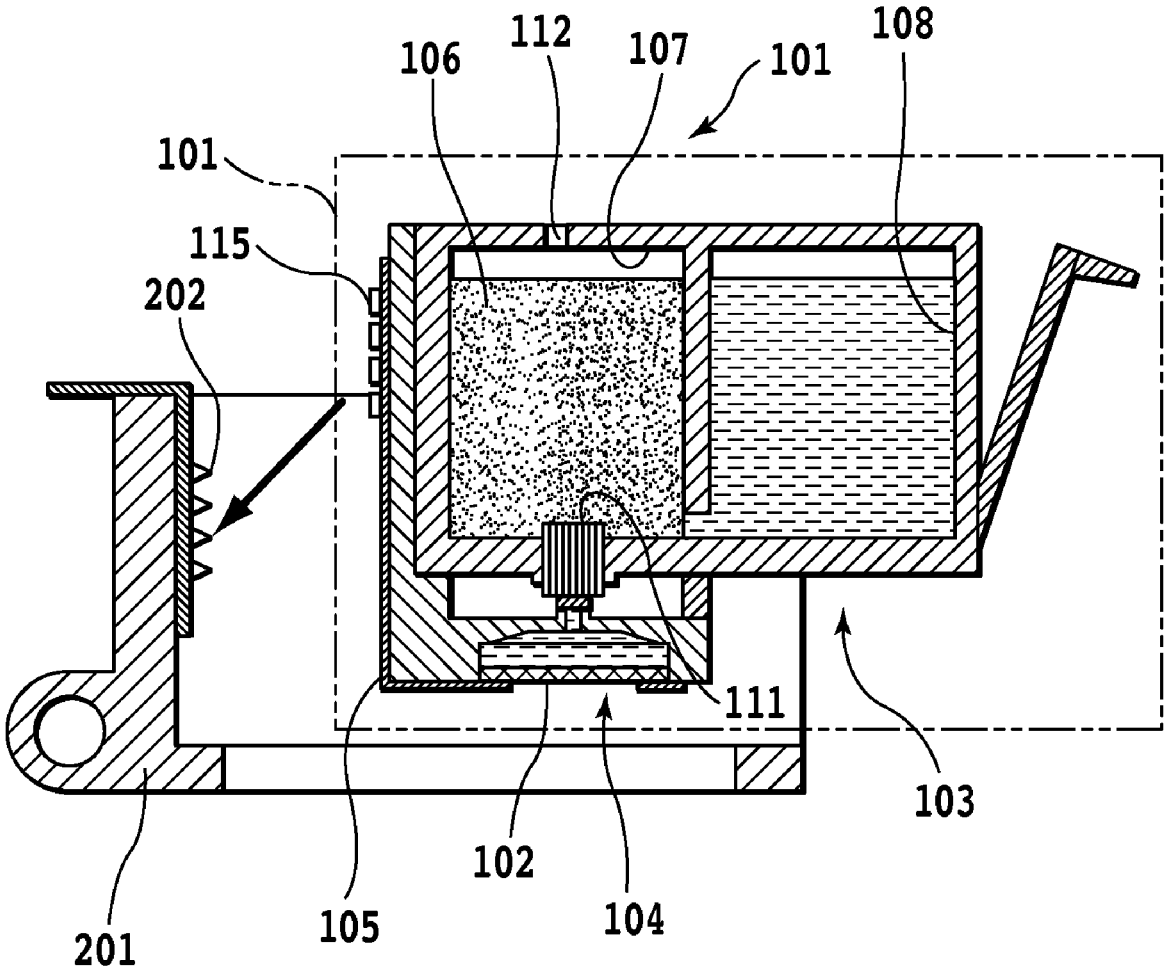
FIG. 2 is a diagram showing that the ink jet cartridge in FIG. 1 is being attached to a carriage in an ink jet printing apparatus main body.
Figure 3:
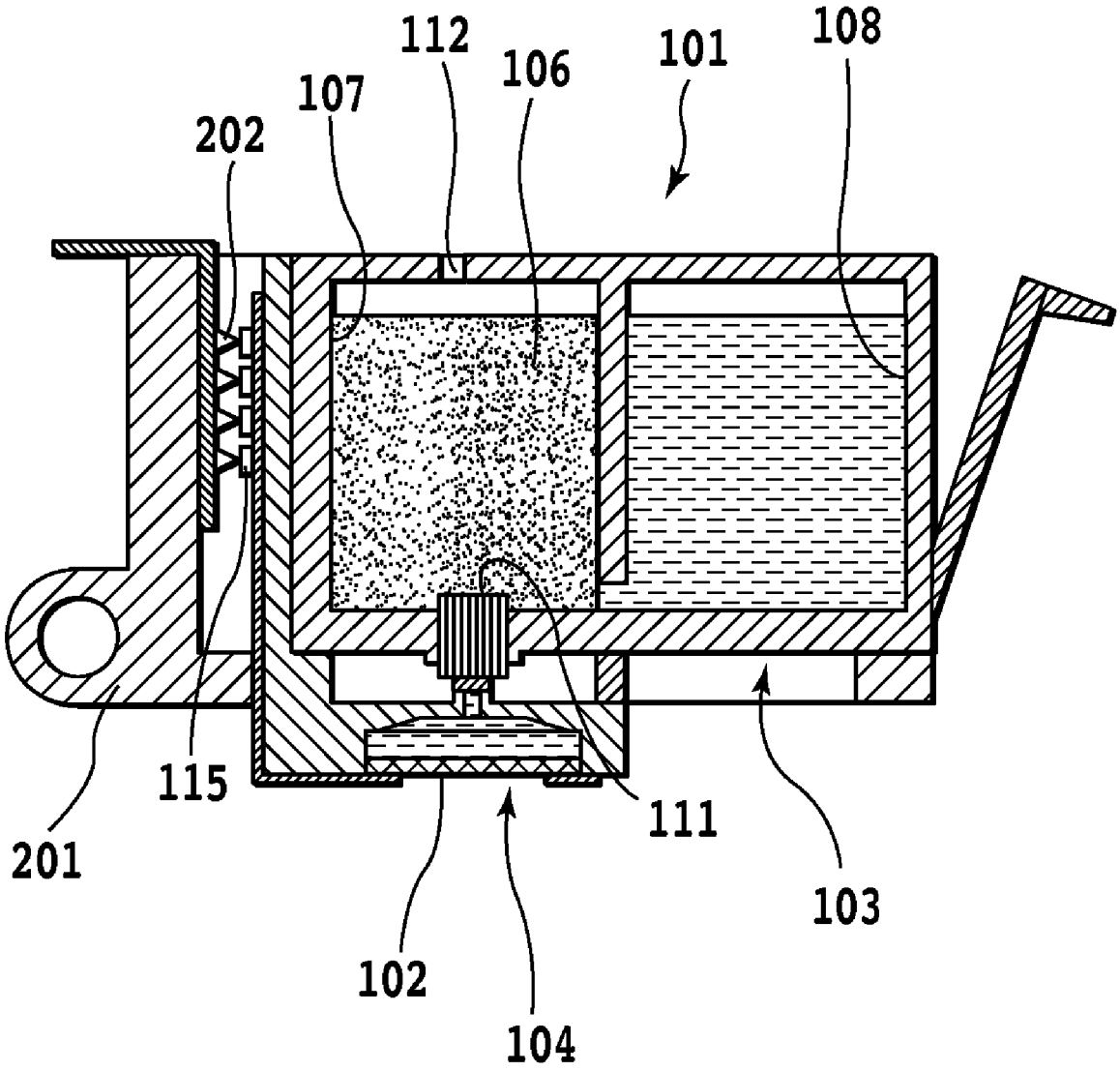
FIG. 3 is a diagram showing that the ink jet cartridge in FIG. 1 has been attached to the carriage in the ink jet printing apparatus main body.

FIG. 2 shows that the ink jet cartridge 101 is being attached to the carriage 201. FIG. 3 shows that the ink jet cartridge 101 has been attached to the carriage 201 and is thus usable. The ink jet cartridge 101 to be used is removably installed and located on the carriage 201 in the ink jet printing apparatus main body as shown in FIGS. 2 and 3. In the installed ink jet cartridge 101, electrode pads 115 are installed at positions corresponding to electrode pins 202 on the carriage and brought into contact with the respective electrode pins 202. The electrode pads 115 are thus electrically connected to the electrode pins 202.

The ink jet printing apparatus including the ink jet cartridge 101, described above, is often commercially available. Users of ink jet printing apparatuses are assumed to be distributed throughout the world. It is thus desirable to assume every distribution environment after shipment from a factory. Makers need to ensure quality until the ink jet printing apparatuses are delivered to the users. Therefore, packing used for distribution of the ink jet printing apparatus needs to be improved.

The present invention is characterized by a structure that seals ink stored in the ink tank portion 103 during distribution.

Figure 4:
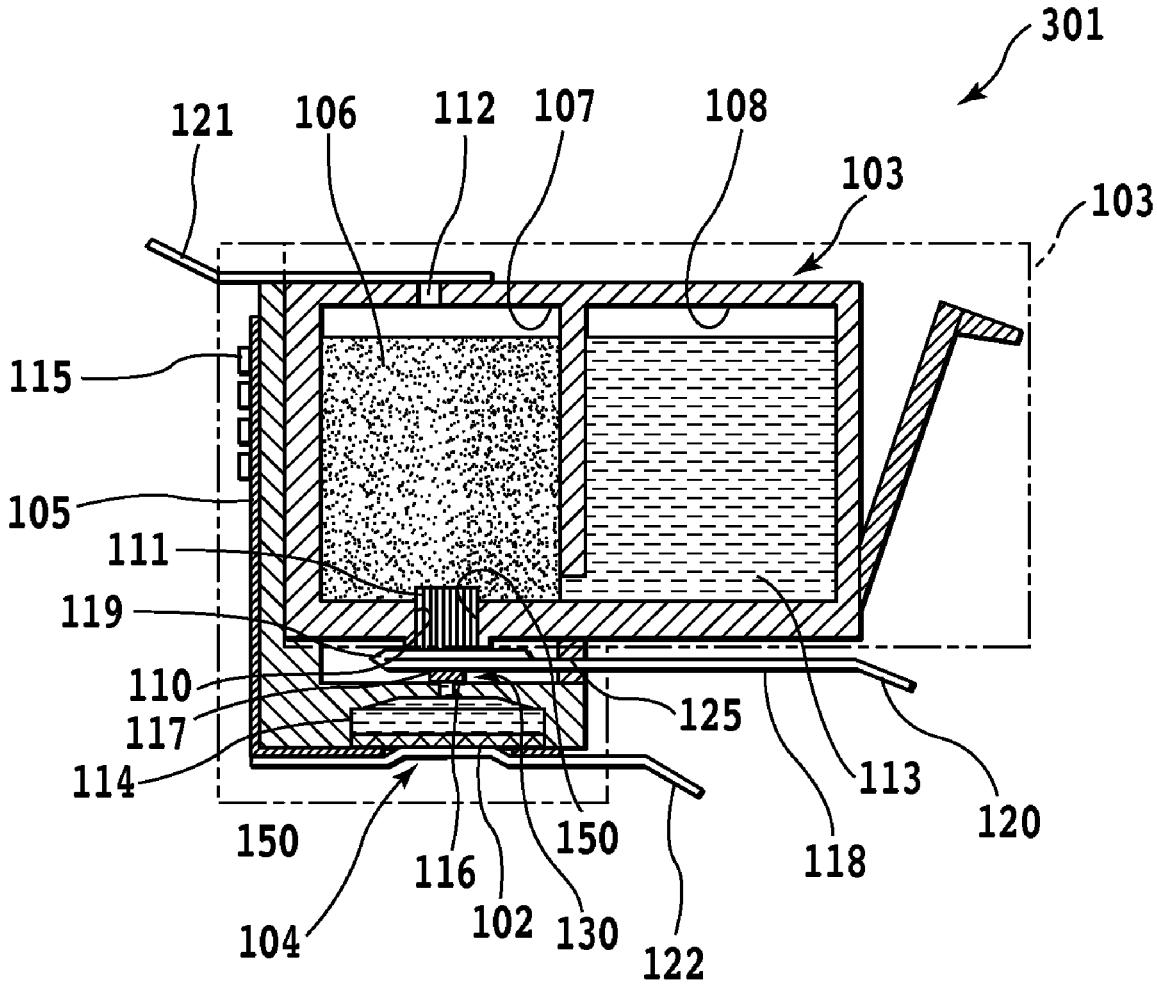
FIG. 4 is a sectional view of the ink jet cartridge during distribution according to the first embodiment of the present invention.

FIG. 4 shows an ink jet cartridge according to a first embodiment of the present invention. FIG. 4 is a sectional view of the condition of an ink jet cartridge 301 during distribution. A seal member 118 is bonded to a peripheral area of the ink supply port 110 by means of thermal welding according to the present embodiment. The seal member 118 seals the print head portion side of the ink tank portion-side ink supply path 150. Thus, the seal member 118 is interposed between the pressure contact member 111 and a filter 117 in the ink supply path 150 to prevent the pressure contact member 111 from contacting the filter 117.

Here, the print head portion side of the ink tank portion-side ink supply path 150 refers to one of the segments into which the ink supply path 150 is divided by the seal member, the portion near the print head portion of the segment extending from the ink tank portion 103. Thus, in the present embodiment, the print head portion-side end of the ink supply path 150 extending from the ink tank portion 103 is covered with the seal member 118 for closure.

The ink tank portion side of the print head portion-side ink supply path 150 is covered with the seal member 118 for closure. Here, the ink tank portion side of the print head portion-side ink supply path 150 refers to the position inside of ink tank portion side of one of the segments into which the ink supply path 150 is divided by the seal member 118, the segment extending toward the print head portion 104.

As a structure that enables connection without ink leakage or air mixture, the ink supply path 150 inside the print head portion 104 has a high-density filter 117 located at a terminal of an ink inflow port 116 and exerting a stronger capillary force on ink than the pressure contact member 111. Thus, in an operative condition, the ink jet cartridge 101 has an ink channel from the ink storing portion 108 of the ink tank portion 103 to the ejection ports 102 in the print head portion 104. Here, a member such as the pressure contact member 111 or the filter 117 which feeds the ink accommodated in the ink tank portion 103 to the print head portion 104 is defined as an ink supply path member 130.

The ink jet cartridge 101 has the ink supply path member 130, provided in each of the ink tank portion 103 and the print head portion 104, to connect the ink tank portion 103 and the print head portion 104 together. That is, the ink jet cartridge 101 has the print head portion-side ink supply path member 130 and the ink tank portion-side ink supply path member 130 to feed the ink from the ink tank portion 103 to the print head portion 104.

The seal member 118 is sandwiched between the print head portion-side ink supply path member 130 and the ink tank portion-side ink supply path member 130. That is, the seal member 118 is sandwiched between the pressure contact member 111 and the filter 117.

A seal fold-back part 119 is formed in the seal member 118 so that one end of the seal member 118, folded back into a U shape, is nipped by a seal gate 125 and reaches the exterior of the ink jet cartridge (during distribution) 301. A seal tab 120 is formed at one end of the seal member 118 and has a length that is appropriate for the user to grip by the hand. The other end of the folded-back seal member 118 remains inside the seal gate 125. The seal gate 125 forms a narrow opening that is sufficient to allow the seal member 118 to barely pass through so as to enable the seal member 118 to project out from the ink jet cartridge 301, while reducing the possible evaporation of the ink. The seal member 118 is welded to the peripheral area of the ink supply ports 110 and stably attached to the ink jet cartridge 301 by sandwiching the seal member 118 between an upper part and a lower part of the seal gate portion. In the present embodiment, the seal member 118 is stuck to a wall surface of the ink tank portion 103 with the pressure contact member 111 pushed into the absorber 106. Consequently, the seal member 118 can be present as a plane that is flush with a plane forming the wall surface of the ink tank portion 103 in the peripheral area of the ink supply port 110. The seal member 118 can thus be stuck to this surface by firmly bonding the seal member 118 to the surface.

In the present embodiment, the seal member 118 is welded to the wall surface of the ink tank portion 103 with the pressure contact member 111 pushed inside the absorber 106 to provide a space that allows the seal member 118 to be welded to the wall surface. However, the location of the seal member 118 is not limited to the form in which the seal member 118 is welded to the wall surface of the ink tank portion 103 as is the case with the present embodiment.

The seal member 118 may be located so that at least one of the print head portion side or ink tank portion side of the ink supply path 130 is pushed toward the ink tank portion side or the print head portion side across the seal member. In this case, the seal member 118 may be fixedly sandwiched between the pressure contact member 111 and the filter 117 so that the filter 117 is pushed toward the print head portion side. In the present embodiment, the seal member 118 is welded to the wall surface of the ink tank portion 103 around the periphery of the ink supply port 110 with the ink tank portion side of the ink supply path member 130 pushed toward the ink tank portion. The seal member 118 is thus located so as to cover the ink tank portion side of the ink supply path member 130. This provides an area that is appropriate to bond the seal member 118 to the wall surface of the ink tank portion 103.

A material for the seal member 118 is a resin that is the same as or similar to that forming the ink tank portion 103. The compatibility between the seal member 118 and the ink tank portion 103 allows the seal member 118 to be thermally welded to the ink tank portion 103. For example, polypropylene, polyethylene, or ethylene vinyl acetate is used as a material for the seal member 118.

Furthermore, an atmospheric communicating port seal 121 that can be removed for use is welded to the periphery of the atmospheric communicating port 112 in the ink tank portion 103.

In the present embodiment, the seal member 118 is located to cover the ink tank portion-side ink supply path member and the ink tank portion side of the print head portion-side ink supply path member. That is, the seal member 118 covers the pressure contact member 111 and the filter 117. An ejection port seal member 122 is stuck to and located on a surface of the print head portion 104 on which the ejection ports 102 are formed, so as to cover the ejection ports 102. A liquid for distribution is filled in a space including the ink supply port 150 in the ink jet cartridge 301 and the interior of the print head portion 104 and partly defined by the seal member 118 and the ejection port seal member 122. This serves to maintain, during distribution, a condition in which the interior of the print head portion 104 and the ejection ports 102 are filled with the liquid for distribution.

The interior of the print head portion 104 is always and continuously exposed to a liquid such as ink during use. Thus, the surface of the print head portion 104 is formed of a material that has resistance to corrosion and durability in the presence of the liquid such as ink. However, the interior of the print head portion 104 is not assumed to be exposed to a dry condition over a long period. Consequently, if the interior of the print head portion 104 is kept dry, the print head portion 104 may inconveniently be, for example, deformed depending on the material forming the print head portion 104. Accordingly, if the material forming the print head portion may fail to resist corrosion or exhibit durability in the dry condition, the liquid for distribution is stored in the print head portion 104 in order to prevent the above-described inconvenience. In the present embodiment, the liquid for distribution is stored inside the print head portion 104 so that the interior of the print head portion 104 is always and continuously exposed to the liquid even during distribution. This prevents the print head portion 104 from being affected by the exposure of the interior of the print head portion 104 to the dry condition over a long period during distribution.

The ejection port seal member 122 is stuck over the ejection ports 102 in order to prevent nonvolatile components or impurities from being secured to the vicinity of the ejection ports 102, while preventing air from flowing into the print head portion 104. The adhesivity of the ejection port seal 122 in this case need not be associated with a variation in the pressure inside the ink tank portion 103. It is thus unnecessary to provide a high adhesivity for the ejection port seal 122 such that sufficient to close the ink supply path 150 with the seal member 118. Consequently, the amount of paste material used for bonding is such that the paste material applied to a sticking surface of the ejection port seal member 122 does not remain inside the ejection ports 102. This makes it possible to inhibit the ejection ports 102 from being clogged by the paste material remaining inside the ejection ports 102. This in turn makes it possible to inhibit a reduction in the impacting accuracy of the ink. Furthermore, the seal member 108 may be enlarged to reliably prevent the possible evaporation of the liquid for distribution or formed so as to cover the entire ink jet cartridge. The liquid for distribution may be, for example, transparent ink.

As described above, the ink jet cartridge 301 according to the present embodiment closes the ink tank portion side of the ink supply path 150 with the seal member 118. Thus, even when the ink tank portion side is firmly closed with the seal member 118, the paste material is prevented from affecting ink ejection. Consequently, even when the ink tank portion 103 is closed with the seal member 118, the impacting accuracy of the ink is prevented from being reduced. Furthermore, the ink jet cartridge according to the present invention allows the seal member 118 to be firmly bonded to the ink tank portion 103 without limitations on the amount of paste material. The ink tank cartridge can thus withstand a variation in the pressure inside the ink tank portion 103 caused by vibration or a variation in temperature or atmospheric pressure during distribution. This makes it possible to prevent the possible peel-off of the seal member 118 and the possible leakage of the ink from the ink jet cartridge during distribution. Furthermore, the closed condition of the ink tank portion 103 is maintained over a long period. The present embodiment can also inhibit the possible evaporation of the ink stored inside the ink tank portion 103 as well as the resulting decrease in the amount of ink available and the resulting increase in the viscosity of the ink. Therefore, when a user having purchased the ink jet cartridge according to the present embodiment performs unpacking, the quality of the ink jet cartridge exhibited immediately after the shipment from the factory is maintained.

When the ink jet cartridge according to the present embodiment is used, first, the atmospheric communicating port seal 121 is peeled off. Then, a tank seal tab 120 is pulled out to remove the seal member 118 from the ink jet cartridge 301. Thus, nothing now supports the pressure contact member 111, which slides under the stress of the absorber 106 and comes into contact with the filter 117 in the ink inflow port 116. Furthermore, the atmospheric communicating port seal 121 is peeled off before the seal member 118 is peeled off. The seal member 118 is thus peeled off after the communication between interior of the ink tank portion 103 and the atmosphere through the atmospheric communicating port 112 has been established to balance the pressure inside the ink tank portion 103 with the atmospheric pressure. Consequently, the pressure inside the ink tank portion 103 is reduced before the print head portion 104 communicates with the ink tank portion 103. Thus, during distribution, it is inhibited that the pressure inside the ink tank portion 103 increases and the ink inside the ink tank portion is introduced into the print head portion 104 with the increased pressure maintained. This makes it possible to inhibit the ink from leaking through the ejection ports 102 in the print head portion 104. The order in which the seals are peeled off may be displayed on the ink jet cartridge to attract the user's attention or may be described in a manual. Another method may be used to inform the user of the order.

In this case, since the pressure contact member 118 is pressed by the absorber 106, the pressure contact member 118 is in pressure contact with the filter 117. Thus, the pressure contact member 118 and the filter 117 guide the ink to the print head portion 104 to allow the ink to be supplied to the ejection ports 102 with the negative pressure generated in the absorber 106 is kept. In this condition, the ejection port seal member 122 is peeled off to allow the ink to be ejected.

To keep the ink tank portion 103 closed, it is desirable that both the seal member 118 and the atmospheric communicating port seal 121, which are stuck to close the ink supply path 150 and the atmospheric communicating port 112, respectively, be very adhesive. As described above, in the present embodiment, the closure by the seal member 118, which has been limited, is performed at the ink supply path 150 to enable the adhesivity to be improved. The improved adhesivity allows a bonded condition to be maintained even with a variation in the pressure inside the ink tank portion 103. This in turn keeps the ink tank portion 103 closed even during distribution. Here, even with the improved adhesivity of the seal member 118, if the adhesivity of the atmospheric communicating port seal 121 remains unchanged, a rise in the pressure inside the ink tank portion 103 may cause the atmospheric communicating port seal 121 to peel off. The ink may then leak through the atmospheric communicating port seal 121. Thus, when the adhesivity of the seal member 118 is improved, it is desirable to correspondingly enhance the adhesivity of the atmospheric communicating port seal 121.

Second Embodiment

Now, description will be given of a distribution form of ink jet cartridge according to a second embodiment. Components of the second embodiment which can be configured as in the case of the first embodiment are denoted by the same reference numerals in the drawings. Only differences from the first embodiment will be described.

Figure 5:
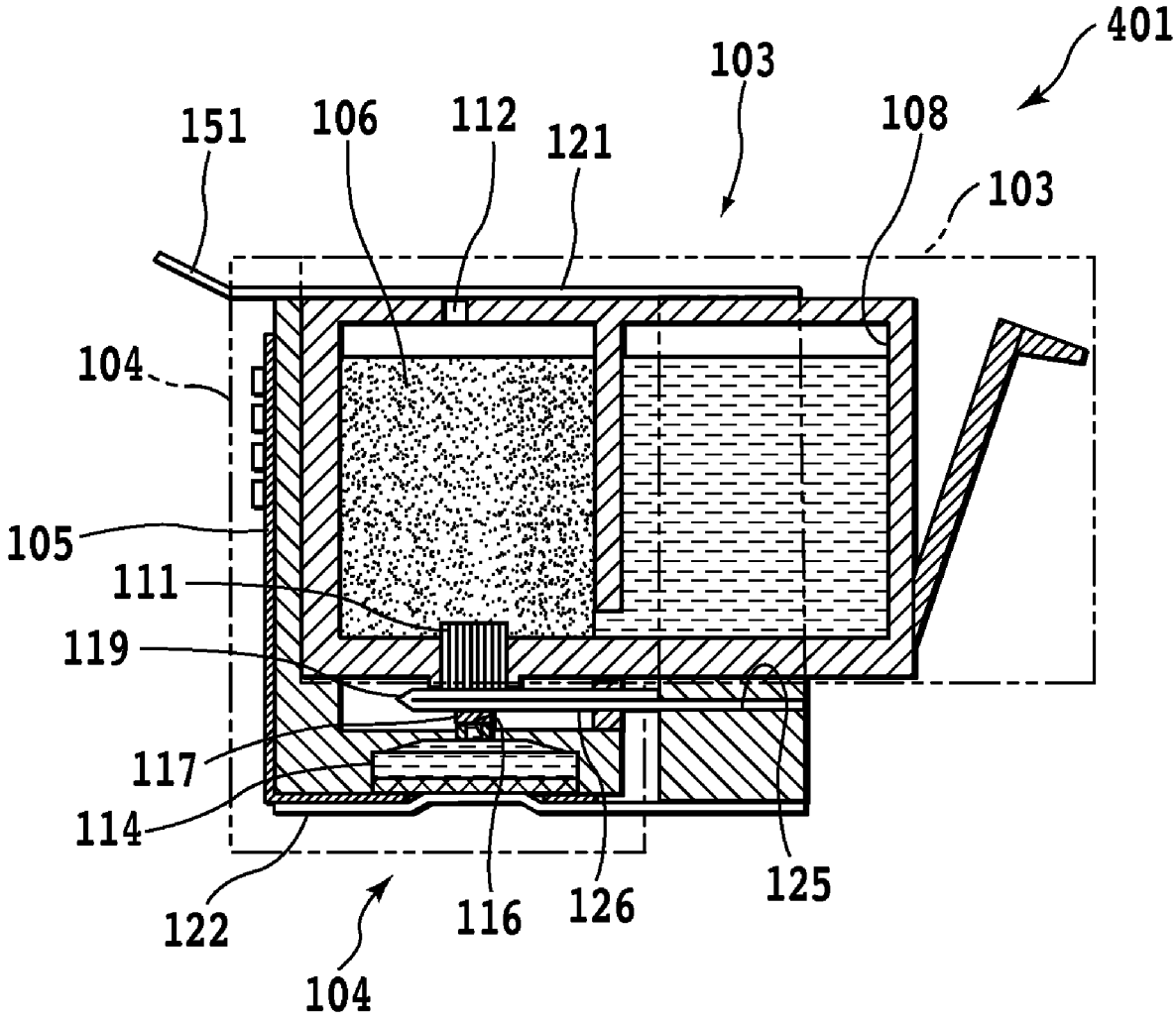
FIG. 5 is a sectional view of an ink jet cartridge during distribution according to a second embodiment of the present invention.

FIG. 5 shows the distribution form 401 of ink jet cartridge according to a second embodiment of the present invention. A seal member 126 according to the second embodiment has a seal fold-back part 119 formed thereon where the seal member 126 is folded back into a U shape and thermally welded to the periphery of the ink supply ports 110 in the ink tank portion 103. The seal member 126 is folded back at the seal fold-back part 119, and the fold-back parts of the seal member 126 reach the seal gate portion 125. One of the fold-back parts of the seal member 126 then extends in a direction (the front-back direction of the sheet of the drawing) orthogonal, in the same plane, to a direction in which the seal member 126 extends. In the present embodiment, one of the overlapping fold-back parts of the seal member 126 which is located closer to the print head portion extends from the seal gate portion 125 in a direction orthogonal, in the same plane, to the direction in which the seal member 126 extends. This part then extends along a side surface of the ink jet cartridge 401 and integrates with the atmospheric communicating port seal 121, which covers and closes the atmospheric communicating port 112. A tab 151 is also formed at one end of the atmospheric communicating port seal 121 so that the user can grip the tab 151 to peel off the atmospheric communicating port seal 121 in order to allow the use of the ink jet cartridge 401.

The seal member 126 according to the present embodiment not only exerts the effects described in the first embodiment but also makes it possible to save the time and effort otherwise required for the user to peel off the plural types of seals. This is because the atmospheric communicating port seal 121 and the seal member 126 are integrally formed, so that peeling off the atmospheric communicating port seal naturally allows the seal member 126 to peel off.

Furthermore, the tab 151 is formed closer to the atmospheric communicating port seal 121. Thus, when the seal member 126 is peeled off, the atmospheric communicating port seal 121 is always peeled off before the seal member 126 is peeled off. In the first embodiment, the user is informed, through display on the ink jet cartridge or description in a manual or the like, that the atmospheric communicating port seal is peeled off before the seal member 126 is peeled off. However, in the present embodiment, a single seal is peeled off into which the atmospheric communicating port seal 121 and the seal member 126 are integrated across the tab 151. Using this process to peel off the integrate seal allows the separate seals to be naturally peeled off in the above-described order. Consequently, the seals are peeled off in the predetermined order by performing the peel-off in an ordinary manner without the need to inform the user of the order of the peel-off. Thus, the user need not be conscious of the order in which the seals are peeled off and can thus handle the ink jet cartridge easily. Also in the embodiment, the order in which the seals are peeled off may be described on the ink jet cartridge or in a manual or the like to inform the user of the order.

Furthermore, with the reduced number of seal products required, only one waste seal member results from the peel-off; this prevents the plurality of waste seal members from scattering after the peel-off.

Additionally, in the present embodiment, one of the fold-back parts of the seal member 126, that is, the seal member located closer to the print head portion, is integrated with the atmospheric communicating port seal 121. Thus, when the seal member 126 is peeled off, one of the fold-back parts of the folded-back seal member 126 which is closer to the print head portion and is not welded to the ink tank portion 103 is first pulled. Consequently, one of the fold-back parts of the seal member 126 which is not welded first moves toward the seal gate portion 125. Then, the welded part between the seal member 126 and the ink tank portion 103 is pulled via the print head portion-side unwelded part to gradually peel off the seal member 126. At this point, the print head portion-side unwelded part between the seal member 126 and the ink tank portion 103, which was pulled first, has already moved toward the seal gate portion 125. Thus, the print head portion-side part of the seal member 126 is sagging. In this manner, the welded part between the seal member 126 and the ink tank portion 103 is pulled by the sagging part resulting from the movement of the print head portion-side part of the seal member 126. Consequently, the welded part between the seal member 126 and the ink tank portion 103 is pulled also in an ink ejecting direction (vertical direction). Thus, the seal member can be relatively easily peeled off. If the easiness with which the seal member 126 is peeled off is not taken into account, one of the overlapping fold-back parts of the seal member 126 which is located closer to the ink tank portion may be integrated with the atmospheric communicating port seal 121. Alternatively, instead of being folded back, the single seat may be integrated with the atmosphere communication seal 121.

In the present embodiment, the length by which the seal member 126 extends from the seal gate portion 125 in the direction orthogonal, in the same plane, to the direction in which the seal member 126 is equal to the length of the seal gate 125 in the direction in which the seal member 126 extends. The seal member 126 extends along the ink jet cartridge 401 by this length and integrates with the atmospheric communicating port seal 121. That is, the width by which the seal member 126 extending along the ink jet cartridge 401 is equal to the length of the seal gate 125 in the direction in which the seal member 126 extends via the ink supply path member 130. However, the present invention is not limited to this. For example, the width by which the seal member 126 extends along the ink jet cartridge 401 may further be increased in order to prevent the possible evaporation of the ink stored in the ink tank portion 103. Alternatively, the seal member 126 may cover the entire ink jet cartridge 401 in the direction in which the seal member 126 extends. Furthermore, in the present embodiment, the seal member 126 is integrated with the atmospheric communicating port seal 121. However, the seal member 126 and the atmospheric communicating port seal 121 may be laminated together.

Third Embodiment

Now, description will be given of a distribution form of ink jet cartridge according to a third embodiment. Components of the third embodiment which can be configured as in the case of the first or second embodiment are denoted by the same reference numerals in the drawings. Only differences from the first and second embodiments will be described.

Figure 6:
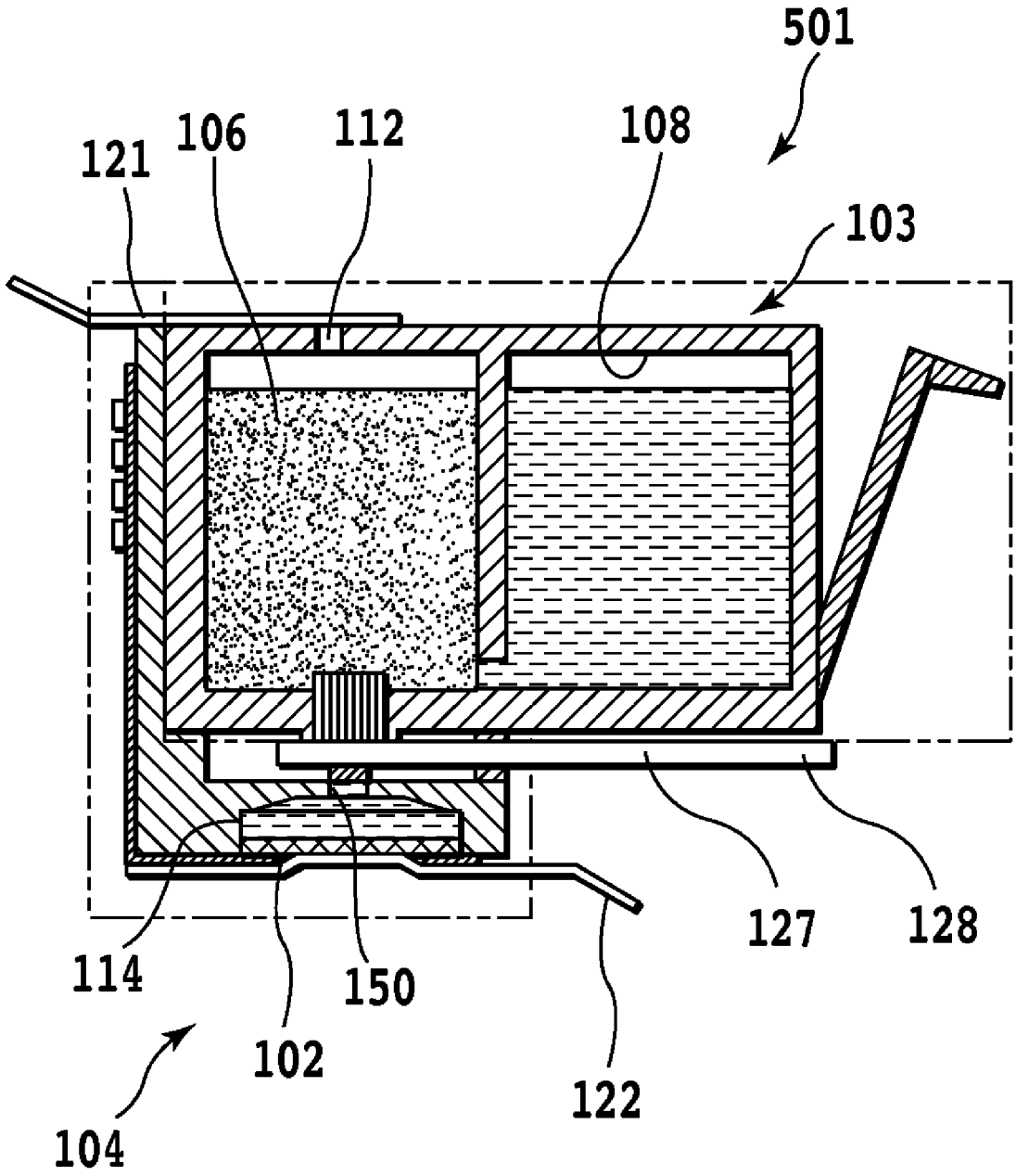
FIG. 6 is a sectional view of an ink jet cartridge during distribution according to a third embodiment of the present invention.

FIG. 6 shows a distribution form 501 of ink jet cartridge according to the third embodiment of the present invention. A seal member 127 according to the present embodiment is formed of elastomer. The seal member 127 of the compressed elastomer is located in the ink supply path 150 between the ink supply port 110 in the ink tank portion 103 and the print head portion 104.

An appropriate material for the seal member 127 formed of the elastomer is chlorinated butyl rubber or hydrogenated nitrile rubber (H-NBR), which has an excellent gas barrier property. However, a resin-containing elastomer may be adopted. The seal member 127 projects out from the ink jet cartridge 501 and has a tab 128 formed at an end thereof and which has a length appropriate for the user to grip by the hand.

The seal member 127 according to the present embodiment is placed in the ink supply path 150 by pressing in the elastomer, which is elastic. Thus, the ink jet cartridge according to the present embodiment exerts not only the effects of the first embodiment but also the effect of facilitating the closure of the ink supply path 150 by omitting the process of folding the seal member. Furthermore, if a large number of seal members are applied, the operation may be mechanically performed. However, it is difficult to mechanically fold, grip, and apply a seal member like a thin film to a predetermined position on the print head portion. The present embodiment replaces such a process with the operation of pressing in the elastomer. A machine executing the process of applying seal members has only to perform easy operations, allowing the process of applying the seal members to be inexpensively achieved.

Fourth Embodiment

Now, description will be given of a distribution form of ink jet cartridge according to a fourth embodiment. Components of the fourth embodiment which can be configured as in the case of any of the first to third embodiments are denoted by the same reference numerals in the drawings. Only differences from the first to third embodiments will be described.

Figure 7:
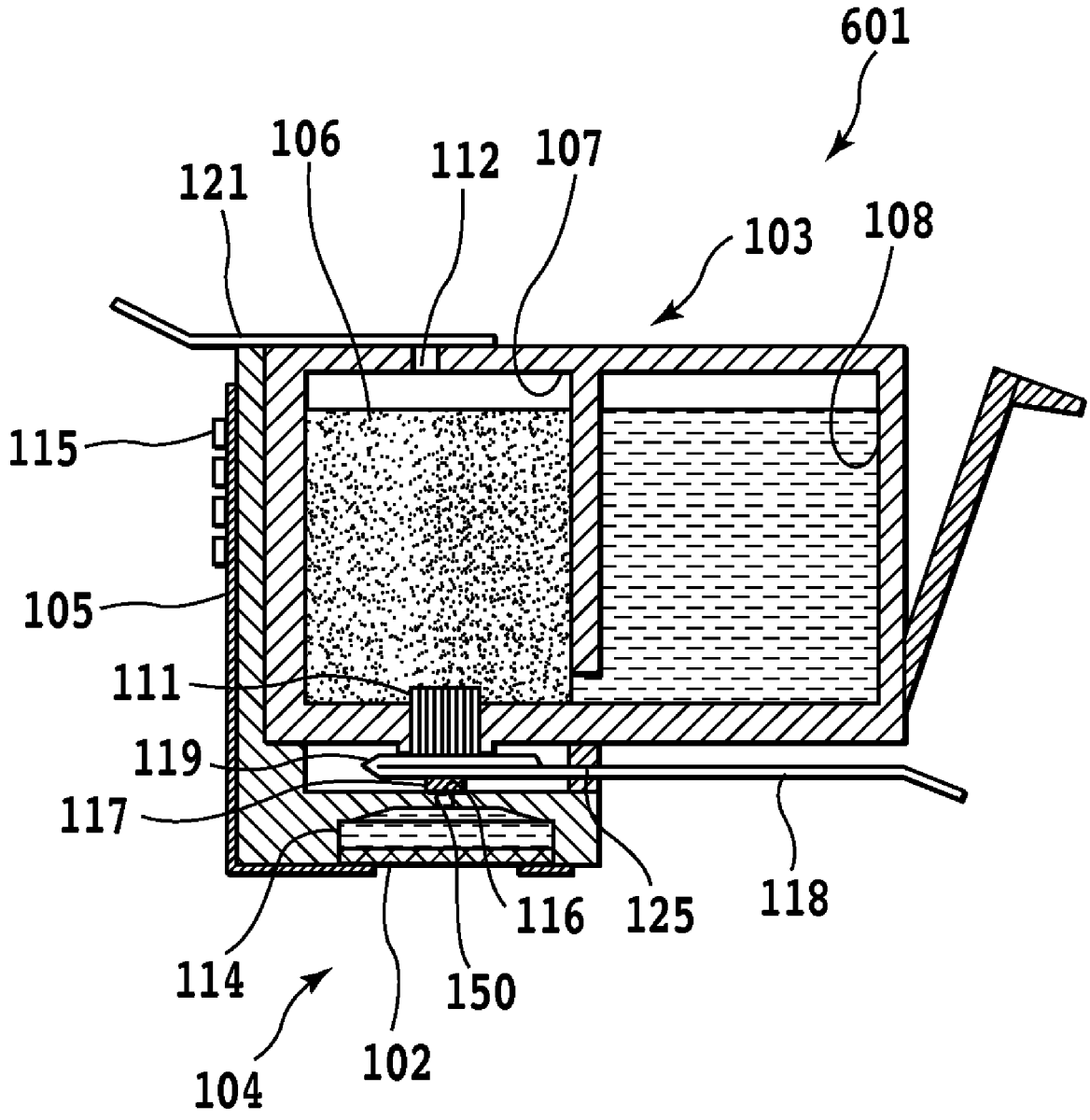
FIG. 7 is a sectional view of an ink jet cartridge during distribution according to a fourth embodiment of the present invention.

FIG. 7 shows a distribution form 601 of ink jet cartridge according to the fourth embodiment of the present invention.

In the ink jet cartridge 601 according to the present embodiment, no liquid for distribution is filled inside the print head 104. In the first embodiment, the liquid for distribution is stored inside the print head portion so that the inside of the print head portion is always exposed to the liquid during distribution. However, in the present embodiment, the print head portion 104 is dry when shipped as shown in FIG. 7. This eliminates the need for the ejection port seal member 122.

Since no liquid for distribution is present inside the print head 104 during distribution, it is unnecessary to deal with the possible leakage or evaporation of the liquid for distribution during distribution. More simple packing may thus be used for the ink jet cartridge 601. This allows the ink jet cartridge 601 to be inexpensively packed, reducing the shipment costs of the ink jet cartridge 601.

In the first embodiment, if the material forming the print head portion has a possibility of failing to resist corrosion or exhibit durability, the liquid for distribution is sealed inside the print head portion, with the ejection ports occluded with the ejection port seal member. However, when the material forming the print head portion is verified resistance to corrosion and durability with respect to a dry condition, the sealing of the liquid inside the print head portion may be omitted as the present embodiment.

The material for the print head portion is selected according to costs, an application, or any other factor. The presence or absence of the liquid for distribution inside the print head may be selected according to the selected material for the print head.

It is possible to apply, to the second or third embodiment, the configuration in which no liquid for distribution is filled inside the print head portion 104 as in the case of the ink jet cartridge 601 according to the embodiment.

Fifth Embodiment

Now, description will be given of a distribution form of ink jet cartridge according to a fifth embodiment. Components of the fifth embodiment which can be configured as in the case of any of the first to fourth embodiments are denoted by the same reference numerals in the drawings. Only differences from the first to fourth embodiments will be described.

Figure 8:
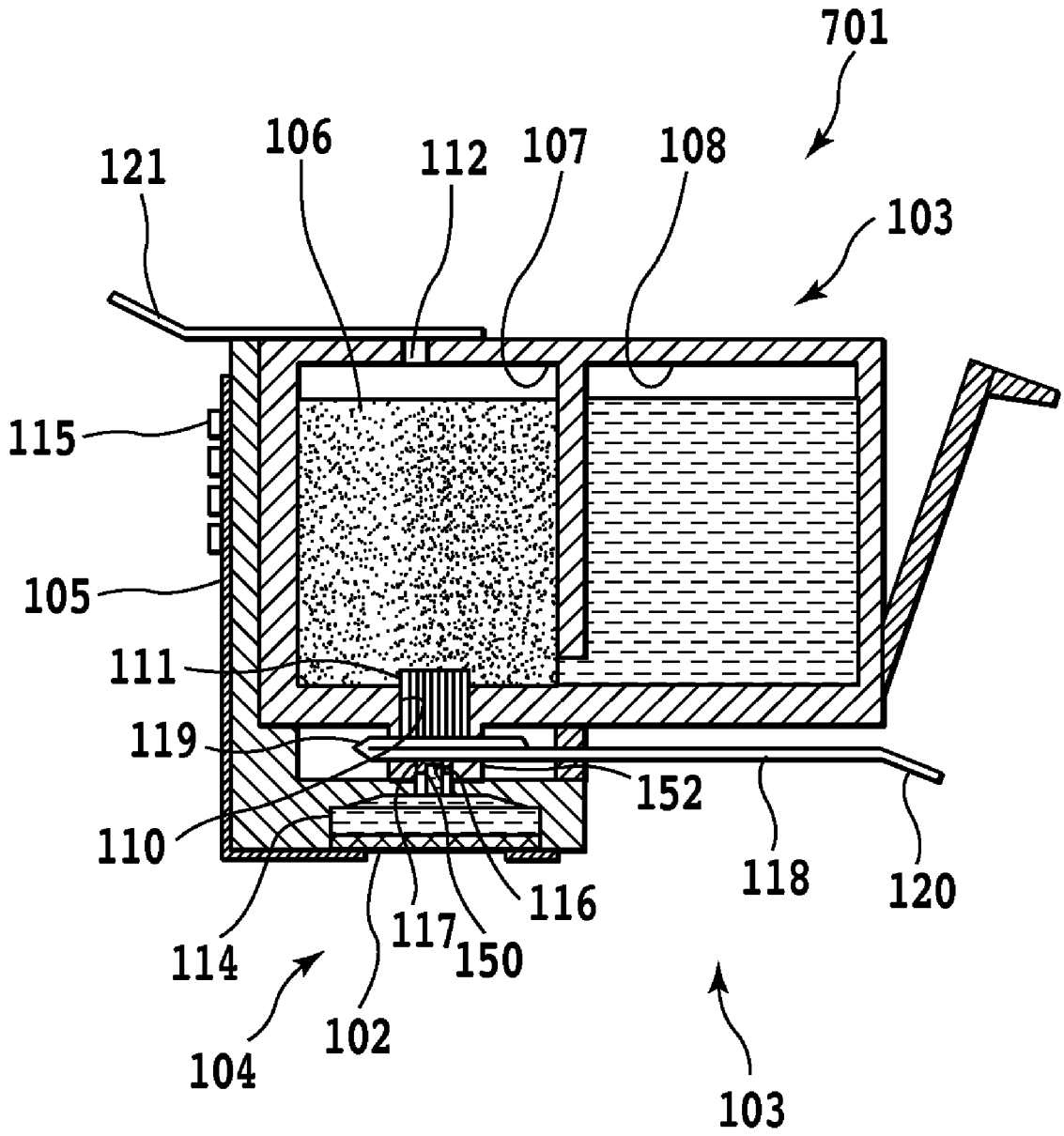
FIG. 8 is a sectional view of an ink jet cartridge during distribution according to a fifth embodiment of the present invention.
Figure 9:
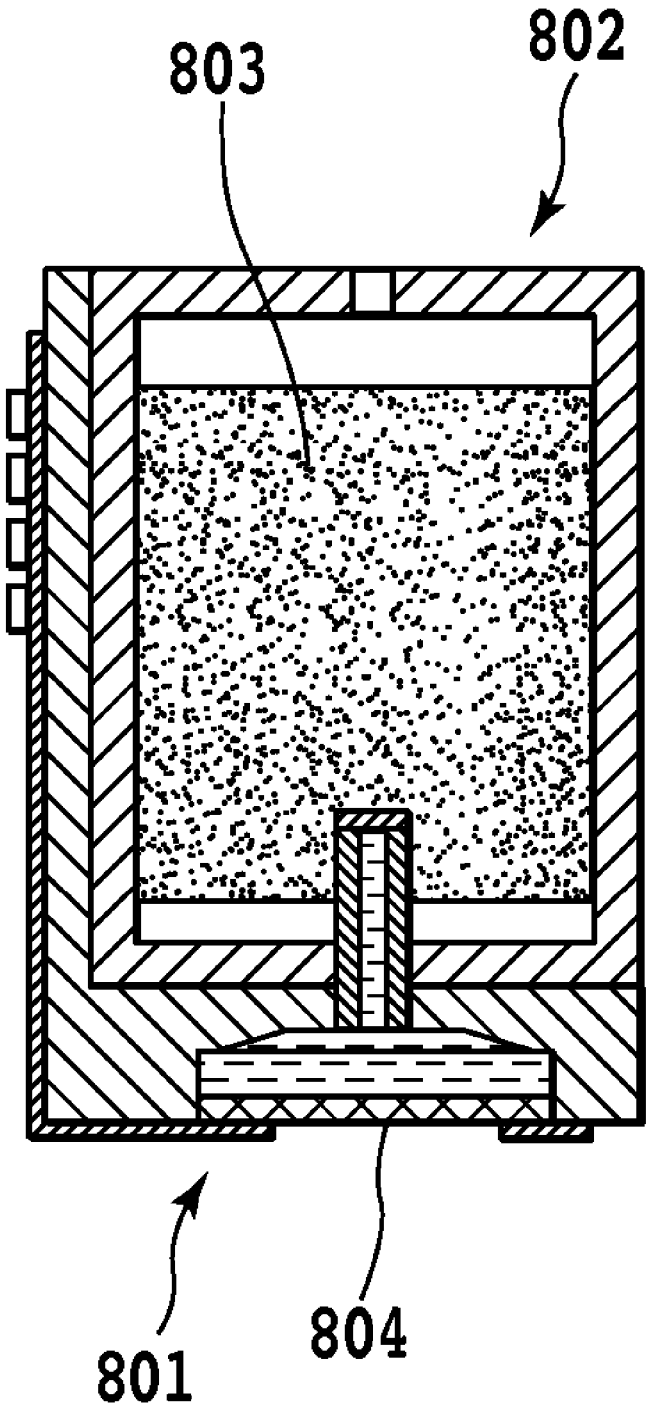
FIG. 9 is a sectional view showing a form of conventional ink jet cartridge.
Figure 10:
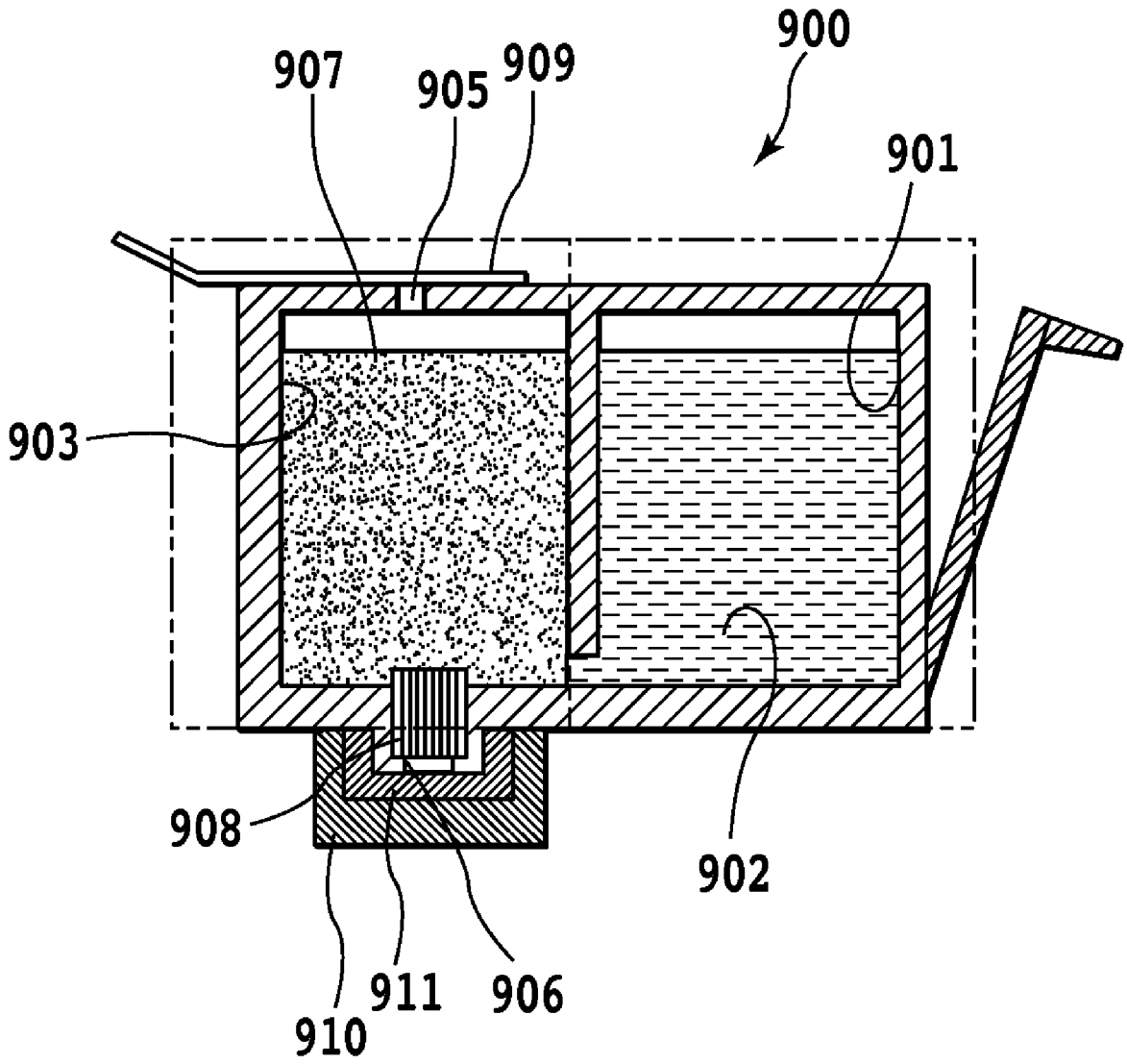
FIG. 10 is a sectional view showing the condition of another form of conventional ink jet cartridge during distribution.

FIG. 8 shows a distribution form 701 of ink jet cartridge according to the fifth embodiment of the present invention.

In the ink jet cartridge according to the first embodiment, the seal gate 125 is the narrow opening that is sufficient to allow the seal member 118 to barely pass reducing the possible evaporation of the ink. However, in the present embodiment, a sealing frame material 152 formed of elastomer is located so as to press the seal member 118 so that the sealing frame material 152 surrounds the ink supply path 150. In the present embodiment, it is unnecessary that the seal member 118 contacts the seal gate 125 to inhibit the possible evaporation of the ink. The seal gate 125 is thus open.

The sealing frame material 152 is elastic and is fixed by being compressively sandwiched between the wall surface constituting the print head portion 104 and the seal member 118. This allows the ink supply path 150 to be more tightly sealed, more strictly inhibiting the possible evaporation of the ink stored inside the ink tank portion 103. Thus, a decrease in the amount of ink and an associated increase in ink viscosity can be inhibited until the ink jet cartridge 701 is delivered to the user. The ink jet cartridge 701 with high quality maintained can therefore be provided to the user.

The seal member 118 is pulled out to allow the use of the ink jet cartridge. However, in the present embodiment, the sealing frame material 152 is formed to be tubular, and after the removal of the seal member 118, forms apart of the ink supply path member 130 and thus a part of the ink supply path 150. The sealing frame material 152 defines a channel through which the ink can flow. The sealing frame material 152 remains at the same position and comes into quick, tight contact with the periphery of the ink supply port 110 in the ink tank portion 103 owing to an elastic action.

In the present embodiment, the seal gate 125 is open. However, the seal member 118 may be bought into contact with the seal gate 125 and may be configured to inhibit the possible evaporation of the ink. Furthermore, the sealing frame material 152 according to the present embodiment may be applied to any of the second, third, and fourth embodiments. Additionally, in the present embodiment, no liquid for distribution is filled inside the print head portion 104, eliminating the need for the ejection port seal member 122, as in the case with the fourth embodiment. However, the liquid for distribution may be filled inside the print head portion 104 as in the case with the fourth embodiment. Furthermore, in addition to the seal gate 125 according to the first embodiment, the sealing frame material 152 according to the present embodiment may be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-154039, filed Jun. 11, 2007, which is hereby incorporated by reference herein in its entirety.

What is claimed is:

1. An ink jet cartridge comprising:

an ink tank portion that accommodates ink;

a print head portion to which the ink accommodated in the ink tank portion is supplied and which ejects the supplied ink;

an ink inflow portion of the print head portion and an ink supply portion of the ink tank portion connecting the ink tank portion to the print head portion so as to supply the ink from the ink tank portion to the print head portion; and a seal member including a first surface sealing the ink supply portion and a second surface sealing the ink inflow portion, the seal member is arranged so that the seal member is sandwiched between the ink inflow portion and the ink supply portion.

2. The ink jet cartridge according to claim 1, further comprising a pressure contact member located at the ink supply portion, wherein the pressure contact member is arranged with the pressure contact member being pushed inward by the seal member.

3. The ink jet cartridge according to claim 1, further comprising:

an ejection port formed in the print head portion so that the ink supplied from the ink tank portion can be ejected through the ejection port; and an ejection port seal member arranged so as to cover the ejection port, wherein a liquid for distribution is filled in a space partly defined by the seal member and the ejection port seal member.

4. The ink jet cartridge according to claim 1, further comprising an atmospheric communicating port formed in the ink tank portion to allow an interior of the ink tank portion to communicate with an exterior of the ink jet cartridge, wherein the seal member covers the atmospheric communicating port.

5. The ink jet cartridge according to claim 1, wherein the ink tank portion has first and second chambers, the first chamber having an absorber placed therein, an atmospheric communicating portion, and the ink supply portion, the second chamber accommodating ink, wherein the first chamber and the second chamber communicate with each other through a communication portion.

6. The ink jet cartridge according to claim 1, further comprising:

a pressure contact member arranged at the ink supply portion; and a filter arranged at the ink flow portion.

7. The ink jet cartridge according to claim 1, wherein the seal member seals the ink supply portion and the ink inflow portion during distribution of the ink jet cartridge.

8. The ink jet cartridge according to claim 1, wherein the ink supply portion is sealed by the first surface being adhered to a frame member arranged so that the frame member surrounds the ink supply portion, and wherein the second surface contacts to the ink inflow portion and the filter without adhesion.

9. An ink jet cartridge comprising:

an ink tank portion that accommodates ink;

a print head portion to which the ink accommodated in the ink tank portion is supplied and which ejects the supplied ink;

an ink inflow portion and an ink supply portion provided to connect the ink tank portion to the print head portion to supply the ink from the ink tank portion to the print head portion; and a seal member located between the ink inflow portion and the ink supply portion, wherein the seal member prevents the ink inflow portion and the ink supply portion from communicating with each other.

10. The ink jet cartridge according to claim 9, wherein the seal member is attached at the ink supply portion so that the seal member can be removed, and wherein when the seal member is removed, the ink inflow portion and the ink supply portion communicate with each other.

11. The ink jet cartridge according to claim 9, wherein the seal member further seals an atmospheric communicating portion and/or an ejection port.

12. The ink jet cartridge according to claim 10, wherein one end of the seal member in which a seal fold-back part folded back into a U shape is formed is extended to an exterior of the ink jet cartridge in the seal member.

13. The ink jet cartridge according to claim 11, wherein the seal member comprises a resin material, wherein the ink tank portion comprises the resin material, and wherein the first surface is adhered to the frame member by a thermal adhesion.

* * * * *